US008727346B2

(12) United States Patent
Chiari et al.

(10) Patent No.: US 8,727,346 B2
(45) Date of Patent: May 20, 2014

(54) DEVICE FOR POSITIONING A PLATE ELEMENT IN AN INFEED STATION OF A PROCESSING MACHINE

(75) Inventors: Mauro Chiari, Denges (CH); Raymond Lambelet, Vufflens-la-Ville (CH)

(73) Assignee: Bobst Mex SA (CH)

( * ) Notice: Subject to any disclaimer, the term of this patent is extended or adjusted under 35 U.S.C. 154(b) by 199 days.

(21) Appl. No.: 13/145,384

(22) PCT Filed: Jan. 14, 2010

(86) PCT No.: PCT/EP2010/000170

§ 371 (c)(1),
(2), (4) Date: Jul. 20, 2011

(87) PCT Pub. No.: WO2010/086087

PCT Pub. Date: Aug. 5, 2010

(65) Prior Publication Data

US 2011/0286820 A1 Nov. 24, 2011

(30) Foreign Application Priority Data

Feb. 2, 2009 (EP) ..... 09001392.1

(51) Int. Cl.
*B65H 9/14* (2006.01)
*B65H 3/24* (2006.01)
*B65H 1/08* (2006.01)

(52) U.S. Cl.
USPC ..... 271/230; 271/42; 271/131; 271/231

(58) Field of Classification Search
USPC ..... 271/267, 243, 230–231, 42, 130, 131; 700/218, 230
See application file for complete search history.

(56) References Cited

U.S. PATENT DOCUMENTS 4,547,115 A * 10/1985 Charbonnet ..... 414/796.4
4,738,442 A * 4/1988 Rodi et al. ..... 271/261
4,989,855 A 2/1991 Polic
5,213,036 A * 5/1993 Tokuno et al. ..... 101/232

(Continued)

FOREIGN PATENT DOCUMENTS

CH 676695 A5 2/1991
DE 2520232 A1 11/1976

(Continued)

OTHER PUBLICATIONS

International Search Report dated May 3, 2010, issued in corresponding international application No. PCT/EP2010/000170.

(Continued)

*Primary Examiner* — Patrick Cicchino
(74) *Attorney, Agent, or Firm* — Ostrolenk Faber LLP

(57) ABSTRACT

A device for positioning a plate element (7*a*, 7*b*, 7*c*) in an infeed station (2) of a machine for treating the element (1), fitted with a conveyor (8, 9), gripping the element (7*a*, 7*b*, 7*c*) which is found in a predetermined intermediate position, and carrying the element (7*a*, 7*b*, 7*c*) in a rated running into successive processing stations (3, 4, 6). The device includes a holding device (18) for temporarily holding the element (7*a*, 7*b*, 7*c*), the holding device moving longitudinally alternatively (A) from an upstream position to a downstream position, and vice-versa, to pick up the element (7*a*, 7*b*, 7*c*) in a rear position and bring it to the intermediate position, and to return empty. A motor (23) moves the holding device (18) longitudinally, from the upstream position to the downstream position, and vice-versa, as a function of the rated running. A detector (27) detects a rear longitudinal position in which the element (7*a*, 7*b*, 7*c*) is found, and emits a position signal. The motor (23) is able to move (A, Aa, Ab, Ac) the holding device (18) from the upstream position to various downstream positions, as a function of the signal emitted by the detection device (27), so as to bring the element (7*a*, 7*b*, 7*c*) from the rear position to the intermediate position.

7 Claims, 1 Drawing Sheet

(56) References Cited

U.S. PATENT DOCUMENTS

| | | | | |
|---|---|---|---|---|
| 5,287,809 | A * | 2/1994 | Greive | 101/485 |
| 5,400,652 | A | 3/1995 | Haar | 83/206 |
| 5,848,785 | A * | 12/1998 | Hardwick et al. | 271/11 |
| 5,889,547 | A * | 3/1999 | Rombult et al. | 347/262 |
| 6,378,862 | B1 * | 4/2002 | Rebeaud | 271/243 |
| 7,603,198 | B2 * | 10/2009 | Chiari | 700/218 |
| 8,056,893 | B2 * | 11/2011 | Mandel et al. | 271/3.21 |
| 2004/0178567 | A1 * | 9/2004 | Edinger | 271/226 |
| 2010/0148428 | A1 | 6/2010 | Kägi et al. | |

FOREIGN PATENT DOCUMENTS

| | | | |
|---|---|---|---|
| EP | 1772405 | A | 4/2007 |
| GB | 564322 | A | 9/1944 |
| JP | 3-295651 | | 12/1991 |
| JP | 5-208232 | | 8/1993 |
| JP | 11-180575 | | 7/1999 |
| JP | 11-227989 | | 8/1999 |
| JP | 2007-099521 | | 4/2007 |
| WO | WO 2008/028309 | A | 3/2008 |

OTHER PUBLICATIONS

Japanese Office Action mailed Jan. 24, 2013 in related Japanese Patent Application No. JP-2011-546667 and partial English translation thereof.

* cited by examiner

DEVICE FOR POSITIONING A PLATE ELEMENT IN AN INFEED STATION OF A PROCESSING MACHINE

CROSS-REFERENCE TO RELATED APPLICATIONS

The present application is a 35 U.S.C. §§371 national phase conversion of PCT/EP2010/000170, filed Jan. 14, 2010 which claims priority of European Application No. 09001392.1, filed Feb. 2, 2009, the contents of which are incorporated by reference herein. The PCT International Application was published in the French language.

The present invention relates to a device for positioning a plate element in an infeed station. The invention also relates to an infeed station comprising such a device for positioning a plate element. The invention also concerns a processing machine incorporating such an infeed station.

A processing machine, for example a converting machine for cutting on a platen, is used notably in the printing and packaging industry, for example for making cardboard boxes from plate elements such as sheets.

The plate elements are taken from a stack situated upstream of the machine and are picked up by a feeder in an infeed station. These plate elements are gripped by a conveyor, which has the form of gripper bars mounted at regular intervals on endless gripper bar chains. The conveyor brings the plate elements into various subsequent processing stations of the machine. The gripper bar chains move and stop periodically in a rated running, so that, during each of their movements, all the gripper bars which have gripped a plate element are passed from an upstream station to an adjacent downstream station that follows.

In the cutting machine, there are successive stations including a station for cutting the plate elements with a cutting die, a station for ejecting the waste with a stripping die and a station for delivering the cut plate elements in a stack.

To obtain a quality cut, positioning the plate elements within the various successive stations is crucial. When cutting a plate element that has already been printed or that has been previously creased with fold lines, the positioning of the plate element must be accurate so that the cutting tools are in perfect register with the printing or with the transformations that have been earlier performed on the plate element. Because of its construction, the conveyor carries out very accurate carrying and stopping of the plate elements at the various stations. This positioning therefore depends on the accuracy of the passage of the plate element in the infeed station from being free to the plate element being gripped by the conveyor.

STATE OF THE ART

To obtain such a positioning of a plate element, positioning devices lay the plate element on a feed table, or on various types of feeders and against their front and side stops, or lays the plate element by means of advancing members such as rollers or belts. For untreated plate elements, the front and side lays used are placed precisely, relative to the succeeding stations. The plate element is therefore rapidly jogged by the advancing members, and then gripped by the gripper bar. The lays are then retracted, and the gripper bar carries the plate element into the next treating station and positions it accurately relative to the tools of the platen of that station.

According to Patent CH-676,695, a positioning device is known in which optoelectronic reading means, such as a camera, are placed above the feed table. The camera can read the front and side edges of the plate element or a printed zone via a print mark or other distinctive sign of the previous processing. The lays are motorized, so as to be able to control a variation and an adjustment of their position and therefore the position of the plate element, depending on the information received by the camera and according to parameters recorded in a memory.

However, a positioning device with lays implies that the advancement of each plate element is practically stopped at the moment of jogging and adjustment. This substantially limits the possible rate for running the plate elements in the machine.

In addition, pressing a plate element against a lay causes formation of a zone of the plate element that is fairly damaged, and visible on the corresponding edge. This damaged zone may then be found on the blank. This damaged zone causes jams of the plate elements in the machine.

Patent DE-25,20,232 discloses a device for feeding a machine with plate elements. A plate element, coming from a pick-up point, is pushed up to front lays which are at the front of a shelf. The plate element is held by suction nozzles provided in the surface of the shelf. Microswitches are located in the plane of the lays and monitor the exact positioning of the front edge of the plate element against the microswitches and the lays. Other lays hold the plate element while it is pushed up to the front lays.

The shelf moves forward, then rearward, as it is moved by a cam driven by a motor rotating in a single direction. The cam pushes a pivoting arm provided with a ball joint at its end. The ball joint is placed in a housing provided under the shelf. The shelf comes back with the arm by being pulled by a spring. When the cam makes a complete rotation, the arm and therefore the shelf carry out a back-and-forth movement.

However, the cam always has to make a complete rotation to move the shelf to its maximum front position, and then return the shelf to its rear starting position. Due to the presence of the cam and lays, the alternating movement stroke of the shelf always remains constant and fixed, and is entirely dependent on the shape of the cam. Changes in format, in this case in the length of the plate element, require a change of the cam, which is incompatible with current requirements to reduce adjustment times as much as possible for the profitability of the machine.

In this prior document, it is not possible to obtain a variation or a longitudinal adjustment of the position of the shelf and therefore of the plate element. In the event of incorrect longitudinal placement of the plate element, the shelf cannot make a correction.

Moreover, no means is provided or described in the prior document for detecting, without contact, the front edge of the plate element. The plate elements are therefore damaged because of their frontal jogging. This situation is accentuated if the element having to be treated is a laminated corrugated cardboard. The front edge of the laminated bottom sheet protrudes relative to the corrugations and the top sheet. The jogging of such a cardboard may cause the bottom sheet to be damaged over a length and/or to fold up or down or against the front edge of the cardboard.

Moreover, with a plate element of laminated corrugated cardboard, the starting reference frame corresponding to the rear longitudinal position is lost or is very imprecise, when the plate element is positioned against a starting gauge or when it comes up against a lay, because of the flexibility of the laminated bottom sheet. The positioning of the plate element gripped by the conveyor therefore becomes imprecise, making for imprecise treating by the machine.

Also known from the Patent document EP-1,044,908 is a method and a device for positioning a plate element, such as a plate element of cardboard for a platen press. This positioning device operates without a lay and comprises temporary holding means, in the form of a movable shelf provided with a temporary attachment of the plate element to be positioned.

This shelf, on the one hand, moves longitudinally from front to rear, due to the crank of the press, and, on the other hand, makes corrective movements. These movements are made about three vertical pivots each secured to a carriage, a central carriage sliding in a longitudinal slide and two side carriages sliding in transverse slides. The correction movements of this shelf are generated by three specific linear motors controlled by optoelectronic detection means.

The correction is made by the movable shelf during the driving of the plate element, so as to bring the front edge of the plate element into a conveyor, in the form of a gripper bar, and into an accurate reference position. The temporary attachment of the shelf can then release the plate element and the shelf can be returned to the starting position to pick up another plate element. This device with continuous accurate positioning for the plate element throughout saves the time needed for jogging the plate elements, which allows increasing substantially the speed of the processing machine.

However, the productivity increase thus obtained requires a considerable investment. Indeed, the cost increase between a conventional jogging system and such a continuous positioning device is considerable and is justified economically only on certain types of machines. Depending on the type of plate element to be treated, the user does not necessarily need a positioning device that is as effective and as complex.

SUMMARY OF THE INVENTION

A main object of the present invention consists in developing a device for positioning a plate element in an infeed station of a machine for treating the element. A second object is to build a positioning device that is particularly simple to build and implement and is not very costly. A third object is to fit an infeed station with a device for positioning an element that requires only a minimum of modifications to operate accurately and quickly. Yet another object is to provide a machine for treating a plate element, allowing the subsequent conveyor to grip the element correctly aligned, thanks to an infeed station and a positioning device, and to bring it into the stations to be treated effectively.

The invention concerns a device for positioning a plate element in an infeed station of a machine for treating the element. The processing machine is fitted with a conveyor which grips the element found in a predetermined intermediate position, and brings this element, in a rated running, into successive processing stations. The device is of the type comprising:

- a device for temporarily holding this element, moving longitudinally alternatively from an upstream position to a downstream position, and vice-versa, to pick up this element in a rear position and bring it to the intermediate position, and to return empty,
- a motor for moving the holding device longitudinally, from the upstream position to the downstream position, and vice-versa, as a function of the rated running, and
- a device for detecting a rear longitudinal position in which this element is found, emitting a position signal.

According to one aspect of the present invention, the motor is able to move the holding device from the upstream position to various downstream positions, as a function of the signal emitted by the detection device, so as to bring this element from the rear position to the intermediate position.

In this entire description, the plate or sheet-like element is defined, as an example, as being made of a material such as paper, flat cardboard, corrugated cardboard, laminated corrugated cardboard, flexible plastic, for example polyethylene (PE), polyethylene terephthalate (PET), bioriented polypropylene (BOPP), or other polymers, or yet other materials.

The element undergoes a method of processing in the processing machine. The processing may be a cutting process. The processing may be a printing process, during which one or more colors are applied to the surface of the element, to place graphic signs thereon and/or to give it an attractive appearance. The processing may also be a process of creasing, embossing, structuring, hot stamping (also known as hot foil stamping), sticking on labels or holograms, or yet other processes. This treated element may comprise a layer of varnish covering some or all of the printed surface.

The processing machine is defined, as an example, as being a platen cutting machine, a printing machine, with at least one printing unit, for example by flexography, by photogravure, by offset, or an embossing unit, or a scoring unit, or a hot stamping unit, or a digital printing or an ink-jet printing machine.

The longitudinal direction is defined with reference to the direction of movement of the element in the machine, on its longitudinal centerline. The upstream and downstream directions are defined with reference to the direction of movement of the element, in the longitudinal direction in the infeed station and in the whole processing machine.

A motor is mechanically connected to the temporary holding device. Not only does this motor cause the temporary holding device to move from upstream to downstream with a plate element and then from downstream to upstream empty with no plate element, but it also causes the same temporary holding device to move from upstream to downstream with a plate element, while taking account of an imprecise or incorrect rear positioning of the plate element that is found on the temporary holding device.

Longitudinal positioning is achieved in an accurate and sufficient manner, thanks to a single motor for moving the temporary holding device. Frontal jogging with its lays is eliminated. The signal emitted by the detection device is used to calculate an instantaneous rear position of the element, a position that is then compared with a reference position. This signal then allows bringing the element from the rear position to the chosen intermediate position.

An update of an existing positioning device takes the form of removing the front lays and using a motor that is controlled and that moves the holding device longitudinally. The existing mechanical drive for the positioning device is disconnected from the general drive of the machine and replaced by this motor.

In another aspect of the invention, an infeed station for a machine for treating a plate element comprises a device having one or more technical features described below.

According to yet another aspect of the invention, a machine for treating a plate element comprises an infeed station having one or more technical features described below.

BRIEF DESCRIPTION OF THE DRAWINGS

The invention will be clearly understood and its various advantages and features will better emerge from the following description of the nonlimiting example of an embodiment, with reference to the appended schematic drawings, in which.

DETAILED DESCRIPTION OF THE PREFERRED EMBODIMENTS

Figure 1:
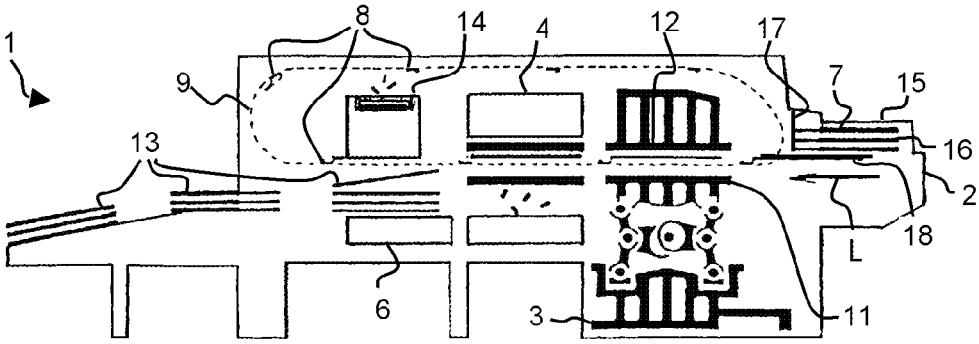
FIG. 1 represents a synoptical side view of a machine for treating an element.

As illustrated in FIG. 1, a machine for treating a plate element, in this case a platen press (1), comprises, in order, various processing stations (2, 3, 4 and 6), an infeed station (2), a cutting station (3), a waste stripping station (4) and a delivery station (6). The plate elements, i.e. the sheets of cardboard to be cut (7), are gripped and carried across the press (1) by a conveyor.

The conveyor may usually be constituted by a gripping member, in this case a series of grippers mounted on a transverse gripper bar (8) that can be secured to gripper bar chains (9), represented schematically in dotted lines, driving the sheets to be cut (7) in the longitudinal direction (Arrow L). The gripper bar (8) grips the sheet to be cut (7) that is in a predetermined intermediate position, and the gripper bar chains (9) brings bring them in a rated running into the successive processing stations (2, 3, 4 and 6).

The gripper bar chains (9) are carried and stopped periodically in a rated running so that, during a carrying, each gripper bar (8) with its sheet (7) is passed from an upstream station to the adjacent downstream station. The positions of the stops of the gripper bars (8) are imposed by a carrying of the gripper bar chains (9) over a constant distance.

Usually, the cutting station (3) comprises a lower movable platen (11) to which is attached the cutting counter form and an upper fixed beam (12), having a lower face on which the cutting tool is attached, or conversely a lower fixed beam and an upper movable platen. The cut sheet (13) is separated from the gripper bar (8) at the delivery station (6), with the gripper bar (8) still holding the front waste. The delivery station (6) is surmounted by a conveyor tape (14) intended to evacuate the front wastes of the cut sheets (13). The cut sheets (13) are then discharged in a stack from the press (1).

The infeed station (2) is provided with a device (15) for positioning the sheet to be cut, bringing the sheet to be cut (7) from the infeed station (2) to the cutting station (3). In the infeed station (2), the sheets to be cut (7) are placed in a stack (16) which presses notably against a gauge (17). The positioning device (15) on one hand comprises means for temporarily holding the sheet to be cut (7) on an infeed device (18). A gap at the bottom of the gauge (17) enables the sheets to be cut (7) to be removed one by one from the bottom of the stack (16) by means of the infeed device (18).

Figure 2:
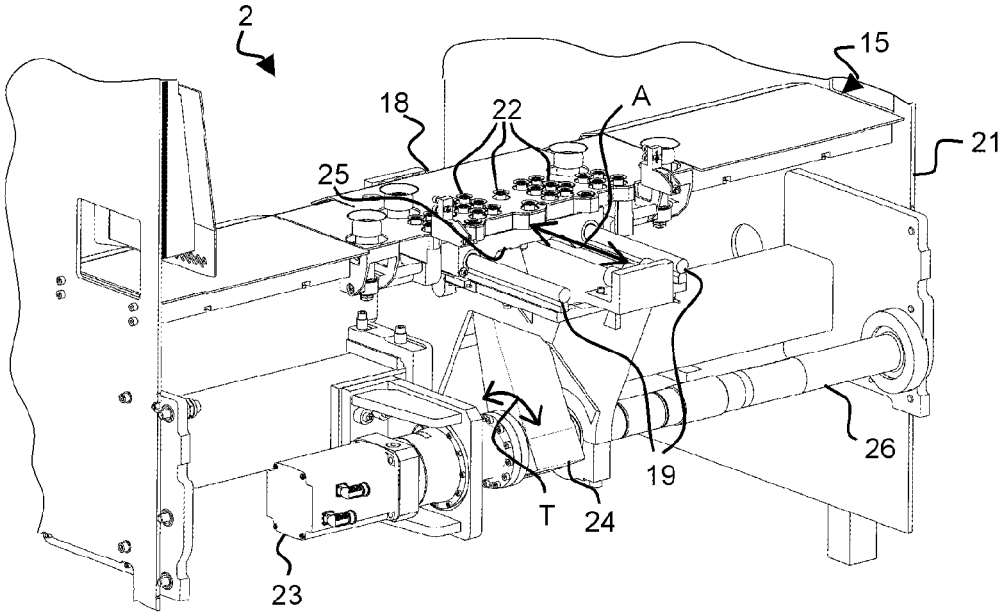
FIG. 2 represents a partial view in perspective of an infeed station of the processing machine of FIG. 1, fitted with a device for positioning the element according to the invention.
Figure 3:
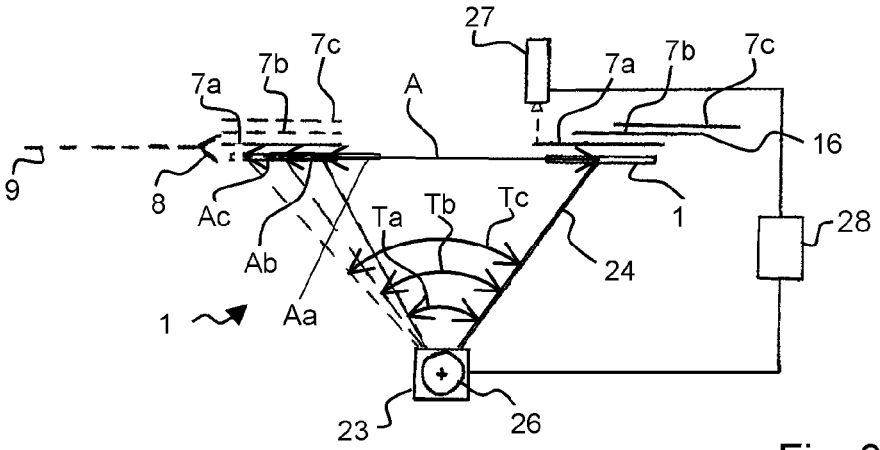
FIG. 3 represents a synoptical side view of the device for positioning the element of FIG. 2, in one upstream position and three downstream positions.

The infeed device (18) moves longitudinally, alternately from an upstream position to a downstream position, and vice-versa, from a downstream position to an upstream position (Arrows A, Aa, Ab and Ac in FIGS. 2 and 3). The infeed device (18) picks up the sheet to be cut (7) in a rear position at the bottom of the stack (16) and brings it to the predetermined intermediate position, to the accurate location in which the gripper bar (8) that will grip it is to be found. The infeed device (18) then returns empty to its upstream position.

In a first embodiment and advantageously, the infeed device (18) may be in the form of a shelf that can move longitudinally (A). The shelf can favorably slide longitudinally (A) on two lower longitudinal slides (19) mounted on a frame (21).

In a first variant of the first embodiment, the shelf (18) may have suction holes (22) connected to a vacuum source (not shown), to pick up the sheets to be cut (7) by their lower face. Means for controlling vacuum suction are also provided to release the sheet to be cut (7) at the accurate moment when the gripper bar (8) grips it.

The positioning device (15) then comprises a motor (23) moving the infeed device (18) longitudinally (A) from the upstream position to the downstream position, and vice-versa, depending on the rated running of the press (1). The motor (23) of the infeed device (18) is positionally slaved according to the rated running of the gripper bar chains (9) of the press (1), usually detected by the angle of the output shaft of the crank of the press (1).

According to the invention, the motor (23) is able to move (A, Aa, Ab and Ac) said temporary holding means, i.e. the infeed device (18), from the upstream position to various downstream positions, depending on the signal emitted by the detection means, so as to bring the sheet to be cut (7) from the rear position to the intermediate position.

The positioning device (15) may preferably comprise a drive arm (24). An articulation part (25) provides the mechanical link between the arm (24) and the infeed device (18). The arm (24) may mechanically secure the infeed device (18) to a drive shaft (26) of the motor (23).

The positioning device (15) also comprises means for detecting a rear longitudinal position (27), in which the sheet to be cut (7) is to be found, and then the positioning device emits a positioning signal. The detection means (27) are located directly downstream of the gauge (17). The detection means (27) are of the optoelectronic sensor type. The means (27) can detect either a front edge of the sheet to be cut (7) and/or a mark previously printed on the upper surface of the sheet to be cut (7), and/or a mark previously printed on the lower surface of the sheet to be cut (7). In the latter case, the detection means (27) then being placed beneath the infeed device (18).

The motor (23) pivots (arrows T, Ta, Tb and Tc in FIGS. 2 and 3) its drive shaft (26) in accordance with an angular travel, which is a function of the rated running of the gripper bar chains (9) of the press (1) and of the signal emitted by the detection means (27) detecting the accurate position of the sheet to be cut (7).

In the prior art, the crank of the press (1) drives not only the lower movable platen (11) of the cutting station (3), but also the shaft (26) which moves the infeed device (18) from upstream to downstream and vice-versa. In the invention, the shaft (26) is mechanically separated from the main motor of the press (1), and the movement of the infeed device (18) is controlled by a computing unit (28) both as a function of the rated running of the press (1) and of the signal emitted by the detection means (27).

The drive shaft (26) causes the arm (24) to tilt (T, Ta, Tb and Tc) from upstream to downstream and vice-versa, so as to move (A, Aa, Ab and Ac) the infeed device (18) from the upstream position to various downstream positions to bring the sheet to be cut (7) from various longitudinal rear positions to a single intermediate position at the gripper bar (8).

As shown in FIG. 3, when the sheet to be cut (7*a*) is located in a correct rear position in the stack (16), the detection means (27) sends a corresponding signal to the computing unit (28) which controls the motor (23). The arm (24) will be tilted (Ta) and the infeed device (18) will be moved (Aa) by the motor (23) on a computed travel, so as to bring the sheet to be cut (7*a*) from the exact rear position to the accurate intermediate position.

When the sheet to be cut (7*b* or 7*c*) is situated in a position that is too far back in the stack (16), the detection means (27) sends a corresponding signal to the computing unit (28) which controls the motor (23). The arm (24) will be tilted (Tb or Tc) and the infeed device (18) will be moved (Ab or Ac) by the motor (23) on a computed travel, so as to bring the sheet to be cut (7*b* or 7*c*) from the position that is too far back to the accurate and corrected intermediate position at the gripper bar (8).

In a second variant of the first embodiment, the infeed device (18) in the form of a shelf can have a gripper, pivotably mounted to temporarily pick up the sheet to be cut (7) by its front edge. Means for controlling the gripper are also provided to release the sheet to be cut (7) at the accurate moment when the gripper bar (8) grips it.

In a second embodiment, the temporary holding means for the sheets to be cut (7) may be in the form of a vacuum conveyor with endless belts driven by the motor, for example substantially similar to those described in the document EP-0,501,213. These types of temporary holding means comprise a suction chamber with one face perforated by many suction holes and which is connected to a vacuum source such as a vacuum suction pump. A set of endless conveyor bands or belts are guided and driven by pulleys located at the front and rear ends of the chamber and pass along the perforated face of the chamber to return to the opposite face.

The motor controlled according to the invention drives one of the end pulleys. The sheets to be cut (7) are thus laid by suction against the endless belts and then brought at an accurate intermediate position to be gripped there by the gripper bar (8). The distance of movement of the sheets to be cut (7) is a function of their starting longitudinal rear position, detected by the detection means (27).

In a third embodiment, the temporary holding means for the sheets to be cut (7) may be in the form of a vacuum conveyor with rollers driven by the motor, for example substantially similar to those described in the document EP-0.363.662. These types of temporary holding means comprise a frame constituted with two beams connected together by a series of crossmembers. These side beams support, in integrated bearings, a series of shafts parallel with one another at right angles to the direction of movement of the sheets to be cut (7). These shafts have a series of drive rollers carved from the block. A plate covers the lower face of the frame, except at rectangular openings through which the lower portion of the rollers passes, which thus emerge from the plate.

The motor controlled according to the invention drives the shafts and thus the rollers. The sheets to be cut (7) are thus laid by suction against the rollers, and then brought at an accurate intermediate position to be gripped there by the conveyor (8). The distance of movement of the sheets to be cut (7) is a function of their starting longitudinal rear position, detected by the detection means (27).

In a fourth embodiment, the temporary holding means for the sheets to be cut (7) may be in the form of a vacuum conveyor with plate and toothed belt driven by the motor. These types of temporary holding means comprise at least three pinions placed in a triangular form. One or more belts are mounted on these pinions by being placed parallel with one another. A vacuum plate provided with suction openings is attached to this belt or these belts.

The motor controlled according to the invention drives the shafts and thus the rollers. The sheets to be cut (7) are thus laid by suction against the rollers, and then brought at an accurate intermediate position to be gripped there by the gripper bar (8). The distance of movement of the sheets to be cut (7) is a function of their starting longitudinal rear position, detected by the detection means (27).

In a fifth embodiment, the temporary holding means for the sheets to be cut (7) may be in the form of a vacuum conveyor with plate and rack and pinion driven by the motor. These types of temporary holding means comprise a rack moved by a pinion. A vacuum plate provided with suction openings is attached to this rack.

The motor controlled according to the invention drives one of the pinions, the drive pinion, the belt or belts and therefore the vacuum plate. The sheets to be cut (7) are thus laid by suction against the vacuum plate and then brought at an accurate intermediate position, to be gripped there by the gripper bar (8). The distance of movement of the sheets to be cut (7) is a function of their starting longitudinal rear position detected by the detection means (27).

In a sixth embodiment, the temporary holding means for the sheets to be cut (7) may be in the form of a vacuum conveyor with plate and electrically operated cylinder playing the role of the motor. These types of temporary holding means comprise an electrically operated cylinder constituted with a fixed shaft and a movable portion driven in movement, inserted onto the fixed shaft. A vacuum plate provided with suction openings is attached to this movable portion.

The drive cylinder is controlled according to the invention and thus drives the vacuum plate. The sheets to be cut (7) are thus laid by suction against the vacuum plate, and then brought at an accurate intermediate position, to be gripped there by the gripper bar (8). The distance of movement of the sheets to be cut (7) is a function of their starting longitudinal rear position detected by the detection means (27).

In a seventh embodiment, the temporary holding means for the sheets to be cut (7) may be in the form of a vacuum conveyor with plate, cam and electrically operated cylinder playing the role of the motor. These types of temporary holding means comprise an arm pivoting in an alternating movement, in a manner similar to what has been described for the first embodiment, in first and second variant. A vacuum plate provided with suction openings is attached to the end of this arm. A cam control drives the arm. Moreover, an electrically operated cylinder is inserted between the arm and the cam control.

When the cam makes a complete rotation, the arm and thus the vacuum plate make an alternating movement according to the rated running. The drive cylinder is controlled according to the invention and thus drives the vacuum plate. The sheets to be cut (7) are thus laid by suction against the vacuum plate, then brought at an accurate intermediate position to be gripped there by the gripper bar (8). The distance of movement of the sheets to be cut (7) is a function of their starting longitudinal rear position detected by the detection means (27).

In an eighth embodiment, the temporary holding means for the sheets to be cut (7) may be in the form of a vacuum conveyor with plate and ball screw playing the role of the motor. These types of temporary holding means comprise a ball screw constituted with a rotating worm gear and a movable nut driven in movement, inserted onto the worm gear. A vacuum plate provided with suction openings is attached to the nut.

The motor controlled according to the invention rotates the worm gear, this nut and thus the vacuum plate. The sheets to be cut (7) are thus laid by suction against the vacuum plate, then brought at an accurate intermediate position, to be gripped there by the conveyor (8). The distance of movement of the sheets to be cut (7) is a function of their starting longitudinal rear position detected by the detection means (27).

The present invention is not limited to the embodiments described and illustrated. Many modifications may be made, nevertheless without departing from the context defined by the scope of the set of claims.

The invention claimed is:

1. A device for positioning a plate element in an infeed station of a machine for treating the element, the machine being fitted with a conveyor configured for gripping said element when said element is in a predetermined intermediate position, and for carrying said element in a rated running into successive processing stations, said positioning device comprising:

a holding device for temporarily holding said element and configured for moving longitudinally alternately from an upstream position to a downstream position, and vice-versa, configured for picking up said element in a rear position and bringing it to the intermediate position, and to return empty to said rear position, a motor connected for longitudinally moving the holding device, from the upstream position to the downstream position, and vice-versa, as a function of the rated running, and a detector for detecting the rear position of said element, and emitting a position signal, wherein the motor is configured to longitudinally move said holding device from said upstream position to the downstream position, as a function of the signal emitted by the detector, so as to bring said element from the rear position to the intermediate position, wherein the holding device comprises a shelf that can move longitudinally and the shelf slides longitudinally on two lower longitudinal slides.

2. The device according to claim 1, further comprising a drive arm configured for mechanically securing the holding device to a drive shaft of the motor.

3. The device according to claim 1, wherein the shelf has suction holes connected to a vacuum source, to pick up the element.

4. The device according to claim 1, wherein the shelf has a gripper, pivotably mounted and configured to pick up the element by a front edge of the element.

5. The device according to claim 1, wherein the conveyor comprises a series of grippers mounted on a transverse bar secured to lateral chains.

6. An infeed station for a machine for treating a plate element comprising a device according to claim 1.

7. A machine for treating a plate element comprising an infeed station according to claim 6.

* * * * *